United States Patent [19]

Ariaz

[11] Patent Number: 4,799,831

[45] Date of Patent: Jan. 24, 1989

[54] FLOWABLE SOLID PRODUCT APPLICATOR

[76] Inventor: Dan Ariaz, 7575 Tamra Dr., Reno, Nev. 89506

[21] Appl. No.: 68,094

[22] Filed: Jun. 29, 1987

[51] Int. Cl.[4] ..... B05B 5/08

[52] U.S. Cl. ..... 406/136; 406/137

[58] Field of Search ..... 406/134, 137, 138

[56] References Cited

U.S. PATENT DOCUMENTS

| | | | |
|---|---|---|---|
| D. 283,327 | 4/1986 | Ariaz et al. . | |
| D. 285,282 | 8/1986 | Ariaz et al. . | |
| 1,727,526 | 9/1929 | Thompson . | |
| 1,736,969 | 11/1929 | Greiser . | |
| 1,905,570 | 4/1933 | Rome | 406/137 |
| 1,970,405 | 8/1934 | Thomas | 406/137 |
| 2,518,811 | 8/1950 | Nicholson | 406/137 |
| 3,123,362 | 3/1964 | Elvers, Sr. . | |
| 3,602,400 | 8/1971 | Cooke . | |
| 3,917,126 | 11/1975 | Beach . | |
| 3,993,359 | 11/1976 | Sweeney | 406/137 |
| 4,059,311 | 11/1977 | Spitzer et al. . | |
| 4,553,698 | 11/1985 | Parker et al. | 406/136 |

FOREIGN PATENT DOCUMENTS

| | | | |
|---|---|---|---|
| 363796 | 11/1973 | U.S.S.R. . | |
| 654511 | 3/1979 | U.S.S.R. | 406/137 |

*Primary Examiner*—Sherman D. Basinger
*Assistant Examiner*—Stephen P. Avila
*Attorney, Agent, or Firm*—Townsend and Townsend

[57] ABSTRACT

An applicator for distributing a flowable solid product in the form of pellets or granules includes a hopper assembly which supplies the product to a product distribution gun, both being coupled to a pressurized air source. The hopper assembly includes a hopper having a downwardly and inwardly tapering bottom which terminates at a central cuplike portion. The product passes from the cuplike portion, through a product line and into an air flow path in the gun. The product is pulled into the gun by a venturi arrangement connecting the product line and the gun. Air is injected into the cuplike portion to fluidize the product in the hopper. Baffles in the hopper control the product flow in the hopper. Bell transitions, having a narrowing and widening cross-sectional dimensions, are used to collimate elongate pellets passing between the hopper and the gun.

11 Claims, 1 Drawing Sheet

FLOWABLE SOLID PRODUCT APPLICATOR

BACKGROUND OF THE INVENTION

Pressurized air is often used to disperse liquid and solid products. The products are often introduced into the air stream through various types of venturi arrangements which pull the product into the air stream. When a solid product, typically in the form of powder, granules or pellets, is dispersed, the supply of solid product often has a tendency to clog or pack up in the container holding the supply of the product; some sort of agitation of the product is often used to prevent this. Both mechanical agitators and pressurized air have been used to agitate solid products.

SUMMARY OF THE INVENTION

The present invention is directed to a flowable solid product applicator by which the product is metered into a flow of air passing through a product distribution gun in an efficient, controlled manner.

The applicator includes a hopper assembly and a product distribution gun, both of which are coupled to a pressurized air source. The hopper assembly includes a hopper having a downwardly and inwardly tapering bottom. The bottom, in the preferred embodiment. terminates at its lower end at a cuplike portion. A product discharge opening is formed in the cuplike opening. The flowable solid material, typically pellets or granules, passes from the hopper through the product discharge opening, through a product line and into the product distribution gun.

Baffles are placed in the hopper to help control the flow of solid product into the cuplike portion and through the product discharge opening. An air injector is used to inject pressurized air into the bottom of the hopper to help keep the product flowable.

The product distribution gun has a distribution inlet through which pressurized air (or other gas) enters. The air flows along an air path through the gun and out the gun muzzle. The flowable solid product is injected into the air path at a venturi arrangement along the air path. The venturi arrangement is coupled to the product discharge opening in the cuplike portion of the hopper by the product line. The flowable solid product is urged along the product line by virtue of the suction pressure created by the venturi arrangement and by any slight positive pressure created by the injection of the fluidizing air into the bottom of the hopper.

When the solid product is in the form of elongate pellets, first and second bell transitions, having a narrowing and widening cross-sectional dimensions, are used at the ends of the product line. The first, narrowing bell transition is used just downstream of the product discharge opening of the hopper. The second, widening bell transition is used just upstream of the product inlet in the distribution gun. The bell transitions act as collimators to help the somewhat elongate pellets align or straighten out while moving along the product line and prior to entering the air path within the distribution gun; this helps to keep the pellets from clogging up at that point.

When pellets are being distributed, baffles having a single triangularly shaped hole along the lower edge has been found to provide appropriate flow of pellets. If a granular material is used, a smaller sized opening can be used, preferably near the lower edges of the baffles.

One of the advantages of the invention is that different types and sizes of flowable solid products can be distributed with very few modifications of the apparatus, the modifications primarily being the sizing of the openings in the baffles.

Another advantage of the invention is that the distribution of the product can be controlled without disturbing the flow of distribution air from the pressurized air source. That is, by controlling the flow of the pellet fluidizing air and controlling the product flow along the product line, the flow concentration of product can be varied while maintaining full flow of the distribution air. This allows the spray density to be varied while maintaining the same maximum dispersion distance.

Other features and advantages of the invention will appear from the following description in which the preferred embodiment has been set forth in detail in conjunction with the accompanying drawings.

DETAILED DESCRIPTION OF THE PREFERRED EMBODIMENT

Figure 1:
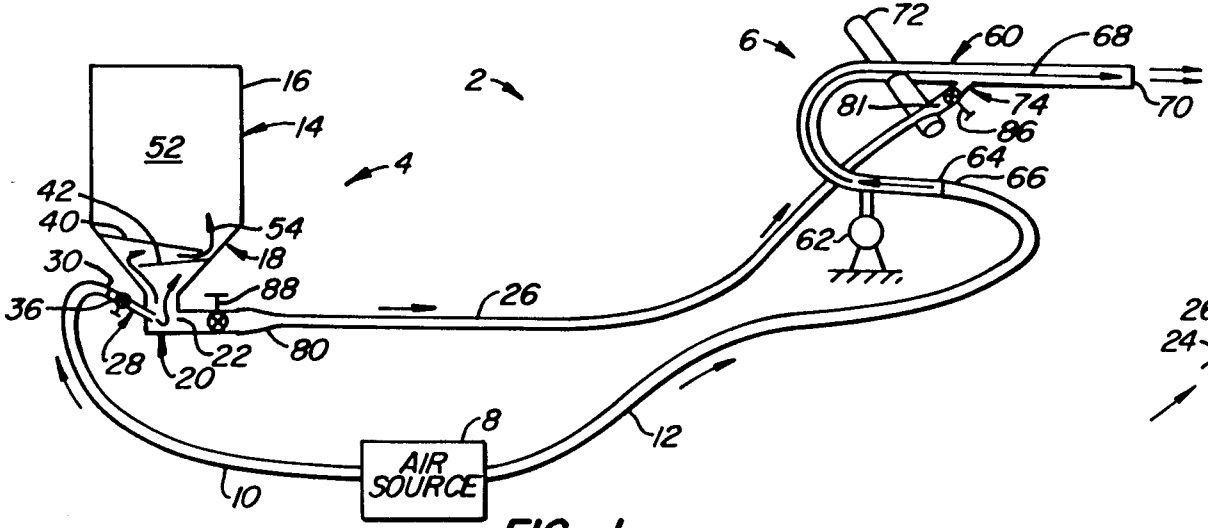
FIG. 1 is a schematic representation of the flowable solid product applicator made according to the invention.

Referring to FIG. 1, a flowable solid product applicator 2 is shown to include broadly a hopper assembly 4, a product distribution gun 6 and a compressed air source 8 coupled to assembly 4 and gun 6 by lines 10, 12.

Figure 2:
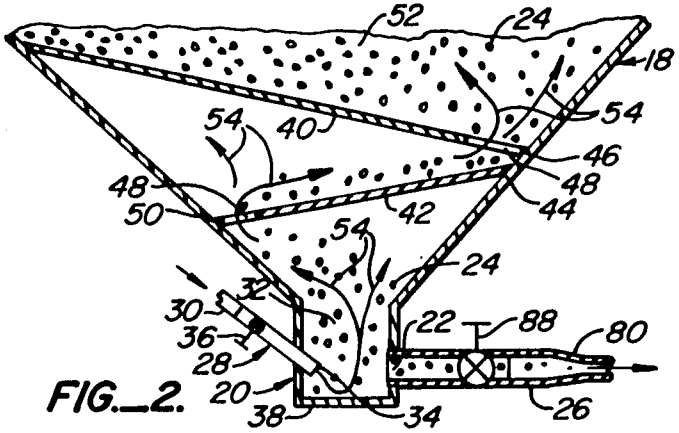
FIG. 2 is an enlarged cross-sectional view of the bottom portion of the hopper assembly of FIG. 1.

Turning now also to FIG. 2, hopper assembly 4 includes a hopper 14 having a generally rectangular circumferential side wall 16 and a downwardly and inwardly tapering bottom 18. Bottom 18 terminates at a central cuplike portion 20. Cuplike portion 20 has a product discharge opening 22 through which product 24 passes from cuplike portion 20 and into a product line 26.

An air injector 28, mounted to the outer end 30 of line 10, opens into interior 32 of cuplike portion 20 at a position 34. Air injector 28 is angled to direct air flow, which is metered by a valve 36, downwardly towards the bottom 38 of cuplike portion 20. The product fluidizing air which passes through line 10 and into bottom 18 at position 34 helps fluidize product 24 within hopper 14 to keep the product free flowing. The product fluidizing air can also help push product 24 through product line 26.

Figure 3:
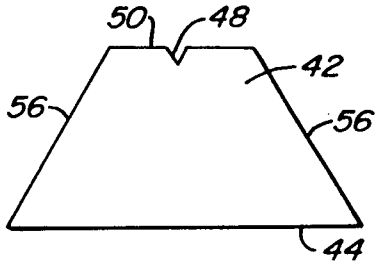
FIG. 3 is a plan view of one of the baffles of FIG. 2.

The proper flow of product 24 into cuplike portion 20 is aided through the use of baffles 40, 42. Baffle 40 is similar in shape to baffle 42, which is shown in FIG. 3. Baffle 42 has an upper edge 44 underlying and near the lower edge 46 of upper baffle 40. Baffles 40, 42 both have triangular openings 48 along their lower edges 48, 50. As shown in FIG. 2. openings 48 are horizontally and vertically offset from one another to provide a somewhat circuitous path for product 24 to follow when flowing from the main supply region 52 of hopper 14, past upper and lower baffles 40, 42 and into cuplike portion 20. Product 24 is fluidized or agitated by the fluidizing air passing through air injector 28 as indicated by flow lines 54.

Figure 4:
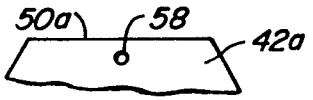
FIG. 4 is an alternative embodiment of the baffle of FIG. 3 showing a baffle opening suitable for use with sand granules of size 16 mesh.

In the preferred embodiment the lower edge 50 of baffle 42 is about 6" long. upper edge 44 is about 11" long and lateral edges 56 are each about 9¾" long. Triangular openings 48 are each an equilateral triangle having sides 1" long. This arrangement has been found to work well with pellets. Pellets include flowable solid products which commonly have dimension larger than about ⅛" but smaller than about ¾". Elongate pellets are generally from ¼" to ¾" in length while round pellets, often made of corn husks for biological products, are usually about ⅛" to ¼" in diameter. If a granular sand-like product (that is, flowable solid product commonly between about 10 and 60 mesh in size) is to be dispersed, triangular opening 48 can be replaced by a hole 58 as illustrated in FIG. 4. Hole 58 having a quarter-inch diameter has been found to work with 16 mesh granules.

Figure 5:
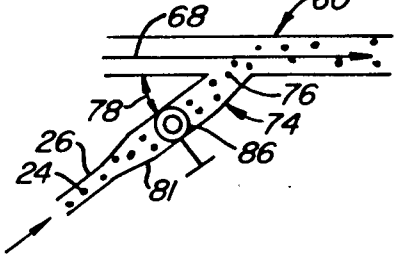
FIG. 5 is an enlarged view of the venturi arrangement of FIG. 1.

Referring now to FIGS. 1 and 5, product distribution gun 6 is seen to include a J-shaped hollow body 60 mounted to a swivel support 62. Body 60 has a distribution air inlet 64 to which the outer end 66 is coupled to provide distribution air to gun 6. The distribution air passes along a J-shaped air path 68 from distribution air inlet 64 to a gun muzzle 70. The direction of distribution gun 6 is controlled through handles 72 extending from J-shaped body 60. Product 24 flows from opening 22, through product line 26 and through a venturi arrangement 74 which connects product line 26 with a product inlet 76 in body 60. Venturi arrangement 74 introduces product 24 into the distribution air stream along path 68 at an acute angle 78 to path 68. The venturi effect caused by the air moving along path 68 creates a low pressure region within venturi arrangement 74 to help pull product 24 along line 26 and thus inject the product into the air stream along path 68.

First and second bell transition regions 80. 81 are positioned at the ends of the product line 26 near opening 22 and product inlet 76. First bell transition 80 narrows downstream while second bell transition 81 widens upstream. Bell transition regions 80, 81 help to keep the product 24 in the form of elongate pellets from clogging at product inlet 76 by straightening or aligning the product as it passes from hopper 14 to gun 6. It has been found that introducing product 24 at acute angle 78 of about 45° and providing bell transition region 81 when elongate pellets are used as product 24 greatly increases the reliability of applicator 2 over applicators in which angle 78 is a right angle and in which no bell transition region 81 is used.

In use, the user activates compressed air source 8 allowing the distribution air to flow along line 12 and through gun 6. The flow of product 24 is regulated by valve 36 at air injector 28 and a valve 86 adjacent venturi arrangement 74. The less air injected through injector 28, the greater the flow of product 24 into gun 6. A shutoff valve 88. adjacent opening 22, is preferably used in either its fully open or fully closed position. After opening valve 88 and adjusting valves 36, 86, air is injected through air injector 28 to fluidize and thus aid the proper flow of product 24 past baffles 40, 42, into interior 32 of cuplike portion 20. Product 24 flows through opening 22, through valve 88, through first, narrowing bell transition 80, through product line 26, through second, widening bell transition 81, past valve 86, past venturi arrangement 74, and into interior of J-shaped body 60 where it enters the air stream flowing along path 68 for discharge through muzzle 70.

Modification and variation can be made to the disclosed embodiment without departing from the subject of the invention as defined in the following claims.

I claim:

1. A supply hopper assembly for use with a flowable solid product comprising:

a hopper for holding a supply of the flowable solid product, the hopper having a hopper bottom, the bottom having a cuplike central portion and tapering walls extending upwardly and outwardly from the cuplike central portion, the cuplike central portion including a generally vertical sidewall and a bottom;

the cuplike central portion of the hopper having a product discharge opening through which the product passes out of the hopper;

a flrst baffle mounted to the tapering walls of the hopper bottom above the product discharge opening, the baffle including a baffle opening through which the product can pass;

a source of pressurized air; and an air injector, connected to the pressurized air source, for introducing pressurized air downwardly towards the bottom of the cuplike portion at an acute angle to the vertical so to help fluidize the product within the hopper.

2. The assembly of claim 1 wherein the bottom includes flat sides.

3. The assembly of claim 1 wherein the baffle tapers downwardly.

4. The assembly of claim 1 wherein the baffle opening is positioned along an edge of the baffle.

5. The assembly of claim 1 wherein the baffle opening is triangular in shape.

6. The assembly of claim 1 including a second baffle mounted within the hopper, the second baffle overlying the first baffle.

7. The assembly of claim 6 wherein said first and second baffles taper downwardly with a lower edge of the first baffle positioned toward an upper edge of the second baffle.

8. The assembly of claim 7 wherein the second baffle is mounted directly to the tapering walls of the bottom of the hopper.

9. The assembly of claim 7 wherein the baffle openings are positioned along the lower edges of the baffles so to be horizontally and vertically offset from one another.

10. An applicator for use with a flowable solid product comprising:

a hopper for holding a supply of the flowable solid product, the hopper having a downwardly and inwardly tapering bottom;

the bottom having a cuplike central portion, an upper edge and tapering walls extending upwardly and outwardly from the cuplike central portion to the upper edge;

the bottom having a product discharge opening formed in the cuplike central portion through which the product passes out of the hopper;

a first baffle mounted within the tapering bottom above the product discharge opening, the first baffle including a first baffle opening through which the product can pass;

a second baffle mounted within the hopper above the first baffle and having a second baffle opening;

said first and second baffles tapering downwardly with a lower edge of the first baffle positioned toward an upper edge of the second baffle;

the baffle openings being positioned along the lower edges of the baffles so the baffle openings are horizontally and vertically offset from one another;

a source of pressurized air;

an air injector, connected to the pressurized air source, for introducing pressurized air into the hopper at an injector position near the product discharge opening so to help fluidize the product within the hopper, the air injector being oriented to direct pressurized air downwardly into the cuplike central portion at an acute angle to the horizontal;

a product distribution gun having a distribution air inlet coupled to the pressurized air source, a gun outlet, an air path between the distribution air inlet and the gun outlet, and a product inlet, fluidly coupled to the product discharge opening, opening into the air path;

a product injector for injecting the product from the product discharge opening through the product inlet and into the air path so the product is discharged through the gun outlet along with the pressurized air flowing along the air path; and a widening bell transition element through which the product flows just upstream of the product inlet, the widening bell transition element defining a widening product flow path segment which widens in a downstream direction, so when the applicator is used to distribute elongate pellets, the free flow of the pellets through the product is aided.

11. An applicator for use with a flowable solid product comprising:

a hopper for holding a supply of the flowable solid product, the hopper having a downwardly and inwardly tapering bottom;

the bottom having a cuplike central portion, an upper edge and tapering walls extending upwardly and outwardly from the cup-like central portion to the upper edge;

the bottom having a product discharge opening formed in the cuplike central portion through which the product passes out of the hopper;

a first baffle mounted within the tapering bottom above the product discharge opening, the first baffle including a first baffle opening through which the product can pass;

a second baffle mounted within the hopper above the first baffle and having a second baffle opening;

said first and second baffles tapering downwardly with a lower edge of the first baffle positioned toward an upper edge of the second baffle;

the baffle openings being positioned along the lower edges of the baffles so the baffle openings are horizontally and vertically offset from one another;

a source of pressurized air;

an air injector, connected to the pressurized air source, for introducing pressurize air into the hopper at an injector position near the product discharge opening so to help fluidize the product within the hopper, the air injector being oriented to direct pressurized air downwardly into the cuplike central portion at an acute angle to the horizontal;

a product distribution gun having a distribution air inlet coupled to the pressurized air source, a gun outlet, an air path between the distribution air inlet and the gun outlet, and a product inlet, fluidly coupled to the product discharge opening, opening into the air path;

a product injector for injecting the product from the product discharge opening through the product inlet and into the air path so the product is discharged through the gun outlet along with the pressurized air flowing along the air path.

* * * * *